United States Patent [19]

Ringdal

[11] 4,147,107

[45] Apr. 3, 1979

[54] AMMUNITION CARTRIDGE

[75] Inventor: Lars Ringdal, Juan-les-Pins, France

[73] Assignee: KUPAG Kunststoff-Patent-Verwaltungs AG, Switzerland

[21] Appl. No.: 767,031

[22] Filed: Feb. 9, 1977

[30] Foreign Application Priority Data

Feb. 17, 1976 [NO] Norway ..... 760525
Dec. 6, 1976 [CH] Switzerland ..... 15297/76

[51] Int. Cl.[2] ..... F42B 5/26
[52] U.S. Cl. ..... 102/43 P; 102/44
[58] Field of Search ..... 102/43 R, 43 P, 44

[56] References Cited

U.S. PATENT DOCUMENTS

| | | | |
|---|---|---|---|
| 3,786,755 | 1/1974 | Eckstein et al. | 102/43 P |
| 3,874,294 | 4/1975 | Hale | 102/44 |
| 3,977,326 | 8/1976 | Anderson | 102/43 P |
| 3,990,366 | 10/1976 | Scanlon | 102/43 P |

FOREIGN PATENT DOCUMENTS

| | | | |
|---|---|---|---|
| 809421 | 4/1969 | Canada | 102/43 P |
| 458996 | 8/1968 | Switzerland | 102/44 |

*Primary Examiner*—Harold J. Tudor
*Attorney, Agent, or Firm*—Holman & Stern

[57] ABSTRACT

A blank or live ammunition cartridge suitable for rifles or guns and including a cartridge case made of a plastics material and comprising a metal bottom insert; the metal bottom insert is part of an integral element comprising said bottom insert firmly anchored in a plastics sleeve, said integral element being inserted into the lower or bottom end of the cartridge case.

A method for manufacturing an ammunition cartridge by forming a metal bottom insert from a metal sheet by deep-drawing; combining said metal bottom insert with a plastics sleeve so as to produce an integral structure; and inserting such integral structure into the bottom end of a plastics cartridge case.

8 Claims, 7 Drawing Figures

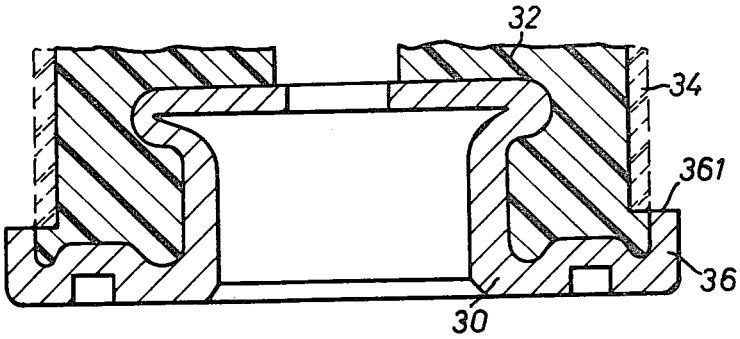
Fig. 3
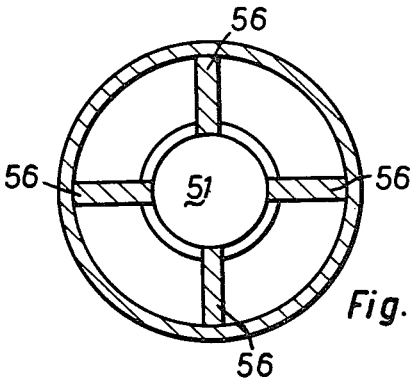
Fig. 5b
Fig. 4b
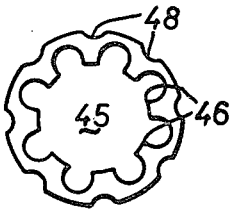
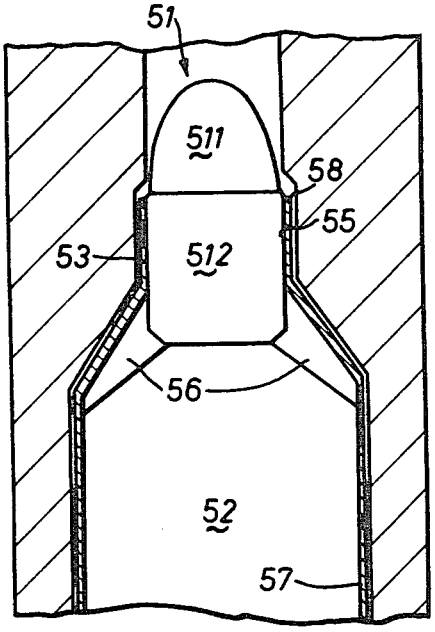
Fig. 5a
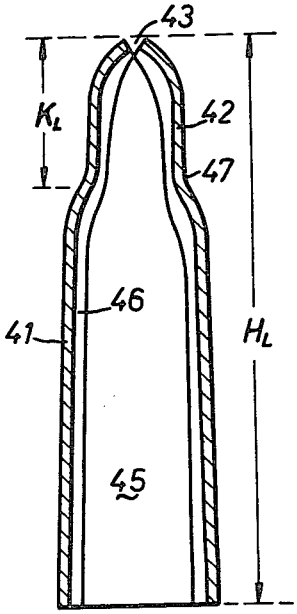
Fig. 4a

AMMUNITION CARTRIDGE

BACKGROUND OF THE INVENTION

This invention relates to improvements in the ammunition art and, specifically, to ammunition cartridges of the type having a plastics cartridge case, i.e. a case that is made, at least in a predominant portion, of a synthetic polymer composition and where the lower end portion of the cartridge case is provided with a bottom insert made of a metal. The term "lower end" relates to that end of the cartridge case which is opposed to the projectile-bearing or projectile imitation-bearing end of the cartridge.

Cartridges of this type are known and have been disclosed, for instance, in Swiss Patent 326,592. Cartridges of this type are used in large quantities as blank rifle cartridges in which the head end of the cartridge case continues into the imitation shape of a plastics projectile which constitutes an integral part of the cartridge case and is furnished at its upper end with a notch or similarly formed predetermined rupture point.

The use of a plastics material for ammunition cartridge cases offers considerable advantages over usual metal cases in regard to cost and production, but necessitates a bottom insert of metal which is suitable as a groove or edge for engaging the usual cartridge extractor and ejector and for receiving and holding a detonator or percussion cap.

A prior art bottom insert of this type is a generally cylindrically shaped, solid metal component having an opening for receiving the detonator cap, an external groove for interaction with the cartridge extractor, and a generally cylindrical upper end portion with its external surface grooved in the manner of a dowel for anchoring inside the wall of a plastics cartridge case. Generally, such bottom inserts are made from aluminum by machining as relatively large thicknesses of material are required in the cartridge bottom. Thus, production of conventional all-metal bottom inserts for plastics cartridges tends to be relatively costly both in view of the comparatively large mass of metal required and the costs of producing the inserts by conventional machining techniques. Insertion of such metal inserts into a plastics cartridge case can present problems such as ruptures of the walls of the plastics cartridge case. Further problems in connection with ammunition cartridges of the type having a plastics case for blank cartridges or projectile-bearing cartridges are encountered in regard to the projectile-like end portion or the connection of the projectile and the plastics cartridge case.

OBJECTS AND SUMMARY OF THE INVENTION

Accordingly, it is the main general object of this invention to provide for improvements in connection with blank or live rifle and gun ammunition cartridges of the type having a plastics cartridge case.

An important specific object is a novel type of insert for ammunition cartridges having a cartridge case made of a plastics material so as to decrease both the amount of metal used for the insert and the costs of producing the inserts.

Another object is an improvement of structure and and function of blank and live ammunition rifle or gun cartridges that have a cartridge case made of a plastics material.

Yet another object is an improved method of producing bottom inserts for ammunition cartridge cases made of a plastics material.

Other objects will become apparent as the specification proceeds.

It has been found that the above and further objects can be achieved according to the invention by means of a novel cartridge bottom insert that includes a metal bottom element integrally connected to a plastics sleeve element, and by certain modifications of the cartridge case with regard to the wall structure and the projectile imitation or projectile-bearing end of the ammunition cartridge.

BRIEF DESCRIPTION OF PREFERRED EMBODIMENTS

According to a first general embodiment, this invention provides for an ammunition cartridge suitable as blank or live ammunition for rifles, said cartridge comprising a plastics cartridge case, i.e. a rifle or gun case consisting, at least in a predominant cartridge case wall portion, of a synthetic organic plastics material and having a lower end portion for receiving and holding a cartridge bottom insert; said cartridge bottom insert being a composite unit structure comprising a metal bottom element firmly secured in a plastics sleeve element. In general, the metal bottom element includes a chamber for receiving a detonator cap and is provided with two coaxial flange means or the like laterally projecting rims having different diameters and being interconnected by a tubular portion. Preferably, the metal bottom element is a shaped integral structure made of a sheet capable of being formed by deep-drawing while the plastics sleeve element is a generally rotationally symmetrical structure that surrounds the upper portion of the metal bottom element and comprises at least one means for engagement with an inner wall portion of the plastics cartridge case as well as an aperture connecting the detonator cap-receiving chamber of the metal bottom insert with a charge-receiving portion of the cartridge case.

According to a second embodiment, the invention provides for a blank ammunition cartridge having a plastics cartridge case, the lower end portion of which is closed with a cartridge bottom insert and wherein the other end portion is shaped as an imitation projectile having a predetermined rupture point and an axial length of not more than 25% of the total axial length of said ammunition cartridge.

According to a third embodiment, the invention provides for an ammunition cartridge having a plastics cartridge case provided with a cartridge bottom insert, wherein the inner wall of the cartridge case is provided with a plurality of elongated ribs for controlling volume and packing of the charge.

In a preferred form of this third embodiment, an exterior wall portion of the plastics cartridge case is provided with a plurality of grooves for improved cartridge extractability from the cartridge chamber of a weapon. Preferably, the ribs and the grooves extend in a direction parallel to or helically around the longitudinal cartridge axis.

According to a fourth embodiment, the invention provides for a live ammunition cartridge having a plastics case with a projectile protruding therefrom and a bond-control coating provided at the interface between the projectile and the plastics cartridge case. If the projectile is made of a metal, the bond-control coating is of the bond-improving type. For projectiles made of a plastics material, the bond-control coating is of the type that prevents an undesired interbonding of the plastics projectile and the plastics cartridge case. With either type of projectile a shoulder wall portion may be provided within the plastics case for defining the position of the projectile.

Preferably, the plastics projectile has a lower projectile portion situated within the plastics case and having a larger diameter than the upper projectile portion that protrudes from the plastics case for improved projectile guidance upon firing without impeding introduction of the projectile-bearing cartridge into the cartridge chamber of a weapon.

It is to be noted that the cartridge bottom insert of the second, third and fourth embodiment of the inventive ammunition cartridge preferably is the novel integral composite having a metal bottom element firmly anchored in a plastics sleeve element as specified in the first embodiment but a conventional all-metal insert may be used as well.

According to a further embodiment, the invention provides for a method of manufacturing an ammunition cartridge with a plastics cartridge case having a lower end portion for receiving and holding a composite bottom insert including a metal bottom element and a plastics sleeve element by (a) forming an integral metal bottom element by deep-drawing of a metal sheet, (b) forming the composite bottom insert by anchoring the metal bottom element in the sleeve element, (c) providing a detonator cap within the metal bottom element, and (d) introducing the composite insert into the lower end portion of the plastics cartridge case. Preferably, the charge will be introduced into the cartridge case prior to introducing the bottom insert.

BRIEF DESCRIPTION OF THE DRAWINGS

The invention will now be explained by means of the drawings in which:

FIG. 3 is a sectional view of the lower end portion of another modification of the inventive cartridge comprising a modified insert.

FIGS. *4a, 4b* are sectional views of an inventive cartridge case provided with a projectile imitation prior to introduction of the bottom insert, and FIGS. *5a, 5b,* are sectional views of the top end portion of a projectile cartridge.

DETAILED DESCRIPTION OF PREFERRED EMBODIMENTS

Figure 1:
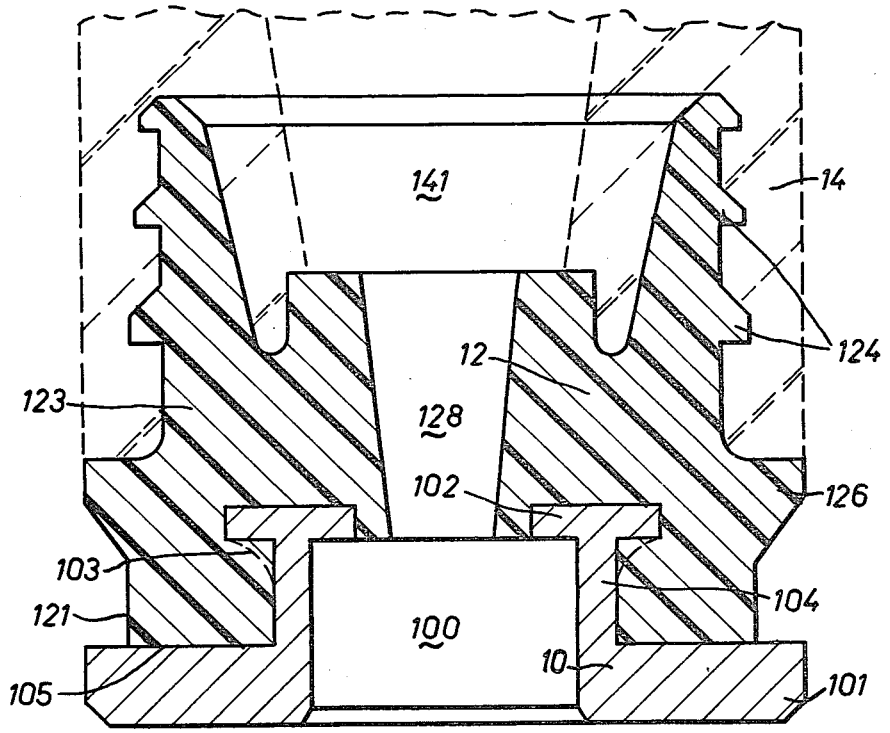
FIG. 1 is a sectional view of the lower end portion of an inventive cartridge illustrating a preferred insert structure as the bottom closure of the plastics cartridge case.

In FIG. 1 the lower end portion of a plastics cartridge case 14 (indicated in broken lines with the central and upper cartridge case portions broken away for a simplified presentation) is closed by means of a composite cartridge bottom insert comprising the metal bottom element 10 that consists of two coaxial disc-like parts or annular flanges 101, 102 and of a tubular or hollow cylinder member 104 interconnecting the flanges. Flange 101 constitutes the actual cartridge bottom, the upper rim or edge portion of which is exposed for the engagement of a conventional cartridge extractor. Flanges 101, 102 and the interconnecting tubular member 104 enclose a generally cylindrical chamber 100 for receiving and holding a conventional detonator or percussion cap, not shown in the drawings.

Bottom element 10 is made of metal such as a light metal or alloy, e.g. aluminum or aluminum alloy, steel, brass or the like material capable of being processed by punching, pressing, deep-drawing and the like shaping methods for mass production purposes. The metal bottom element 10 is embedded or anchored in a rotationally symmetrical plastics sleeve element 12 having a duct or passage 128 for connecting the interior or charge-bearing portion 141 of cartridge case 14 with chamber 100 of the metal bottom insert 10 so that actuation of a detonator cap in chamber 100 will cause ignition of a charge provided in case 14.

Sleeve 12 is of a plastics material, preferably a thermoplastic polymer composition which possesses a ball-pressure hardness (60 inch-ball), at ambient (15°–30° C.) temperature, of at least about 500 kp/cm$^2$ and a modulus of elasticity of at least about $5\times10^{-3}$ kp/cm$^2$. Non-limiting examples of suitable thermoplastic materials include polyolefins such as polyethylene (high density type), polypropylene and the like, polyamides, polyacetals, polyesters, etc. In general, plastics of the type known to be suitable for manufacture of the cartridge case and including conventional additions such as pigments, dyes, fillers, stabilizers and the like can be used for the sleeve element of the inventive bottom insert. Duroplastics, i.e. cross-linked or thermoset polymers such as epoxy resins and the like may be used for the sleeve element, e.g. by casting or molding a duroplastically setting composition to form the sleeve element around the metal bottom element so as to form the composite unit. Sleeve elements of thermoplastic polymer compositions can be produced and shaped by conventional thermoplastics processing methods including injection moulding, compression moulding or other shaping processes with simultaneous anchoring of the metal element, e.g. by providing the latter in the sleeve-producing mold prior to introduction of the plastics material. In general, anchoring of the metal element in the plastics sleeve will be obtained by providing projections or grooves on the outer wall of cylinder 104 and/or by flange 102. Preferably, the laterally projecting portion of flange 102 constitutes the main anchoring component of the metal element but the lower face of flange 102 may be rounded as indicated in broken line 103. However, anchoring projections that have an analogous effect may be formed by continuous or interrupted beadings, ribs, webs or lengths of thread in the outer wall of cylinder 104. Alternatively, a firm connection between metal element 10 and plastics sleeve 12 can be obtained by screwing in, that is, by suitably threaded elements and without a plastic deformation of the sleeve material.

The general shape of sleeve element 12 as illustrated in FIG. 1 is preferred but not critical as long as a sufficiently firm anchorage of metal element 10, on the one hand, and an adequate connection between the sleeve and the cartridge case 14, on the other hand, are ensured. Base portion 121 of sleeve 12 has a generally cylindrical shape, bears against the upper surface 105 of flange 101 and has a smaller outer diameter than flange 101 so as to accord with the desired depth of the extractor groove. Sleeve base 121 widens conically upwards and outwards to form abutment 126 against which the cartridge case 14 bears. A number of beadings 124 is provided at the outer sleeve wall for securing the composite insert in the wall of case 14.

The inventive composite bottom insert consisting of plastics sleeve 12 and metal element 10 firmly anchored therein is used to close the lower end of case 14 in the same manner as prior art all-metal bottom insert pieces. However, with the composite insert according to the invention, a comparatively non-problematic plastics-plastics connection is obtained between the plastics cartridge case and the plastics sleeve of the insert. It is surprising indeed that a major portion of the bottom insert of ammunition cartridges can be made of a plastics material without any disadvantage in regard to the suitability of such cartridge for use as blank or live ammunition even though the explosion pressure occuring upon firing of the charge acts upon the plastics sleeve of the insert rather than the metal bottom. As to the thickness of the plastics sleeve material above the metal bottom element, it is sufficient, in general, if the axial depth of aperture 128 and of the surrounding transition portion 123 is at least about as large as the axial depth of metal element 10.

Figure 2:
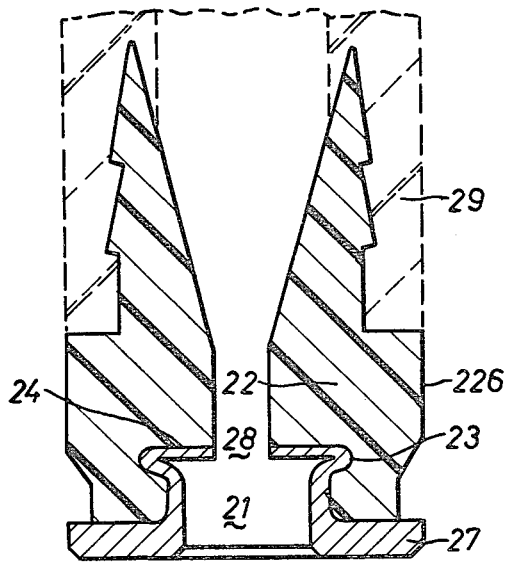
FIG. 2 is a sectional view of the lower end portion of an inventive cartridge having a modified insert structure.

FIG. 2 shows a modification, preferred from its manufacturing aspects, of the metal constituent of the novel composite insert. This metal element is made from a circular disc of metal sheet, capable of being deep-drawn, for example steel, aluminum or brass, generally having the external dimensions and thickness of bottom plate 27. For producing the metal element shown in FIG. 2, the disc is punched or deep-drawn to form chamber 21 with an axial depth greater than that of the final chamber and then upsetting the chamber portion to the desired axial depth while simultaneously forming the external annular beading 23. Aperture 28 in upper wall portion 24 may already be present in the disc or may be formed during upsetting or later. Plastics sleeve 22 represented in a semi-diagrammatical manner for connection with plastics case 29 can be produced and shaped as explained in connection with FIG. 1, or have a somewhat simplified structure as shown in FIG. 2. The axial depth of abutment 226 is increased in a preferred embodiment so as to obtain an enlarged surface of direct contact between the plastics material of sleeve element 22 and the wall of the cartridge chamber of a weapon.

A modified embodiment of the inventive cartridge bottom insert is illustrated in FIG. 3 showing the lower part of plastics sleeve 32 only as well as the bottom portion of a plastics cartridge case 34. The structure of the outer wall portion of sleeve 32 and the correspondingly intermeshing part of the inner wall of case 34 can be made in the manner illustrated in FIG. 1 and 2, or by any other means suitable for mutual connection. As both sleeve 32 and case 34 are made of a plastics material, various bonding methods for such connection will be apparent to the expert.

Metal element 30 is made in a manner similar to that explained in connection with FIG. 2. An upwardly bent external rim 36 is provided having an end face 361 for interaction with the cartridge extractor and ejector mechanism of a weapon. Metal element 30 is anchored in plastics sleeve 32 in the manner explained above. The embodiment of the bottom insert shown in FIG. 3 is especially suitable for gun ammunition cartridges and provides for the use of relatively thin metal sheet materials without detracting from the strength of rim 36 required for ejection of the cartridge case after firing from a weapon.

FIG. 4*a* shows a longitudinal sectional view of the cartridge case for an improved blank ammunition cartridge made essentially of a plastics material only. Preferably, the bottom insert not shown in FIG. 4*a* is made as explained in connection with FIG. 1 and 2 but advantages will be achieved even if a prior art all-metal insert is used.

FIG. 4*b* shows a cross-sectional view of the cartridge case illustrated in FIG. 4*a*. Cartridge case 41 has an upper end piece 42 shaped as an imitation projectile and is made of plastics material throughout. The top of end piece 42 is furnished with a notch 43 at which the wall of the casing can rupture when a charge (not shown) contained in the chamber 45 is detonated. Preferably, length $K_L$ of projectile-shaped end piece 43 is at most 25% of the total length $H_L$ of the cartridge case, because this provides for savings in material and space and decreases the danger of an intentional or accidental weakening of case 41 in the transition or neck portion 47. Preferably, the inner wall surface of plastics cartridge case 41 is furnished with a number of ribs or webs 46 extending axially or helically in a continuous or interrupted manner over at least a part of the case wall. The volume of the internal charge-receiving space 45 of the case as well as the charge can be controlled in this manner, i.e. adaption to the intended charge volume and improved uniformity of charge distribution. In addition, ribs 46 may serve to prevent agglomeration of a charge consisting of particulate explosives. The outer wall of case 41 may be furnished with a number of troughs or grooves 18 for facilitating extraction of the case from the cartridge chamber of the weapon. Structuring of the cartridge case wall 41 as shown in FIG. 4*b* offers additional advantages in regard to manufacture of the cartridge case by injection moulding of thermoplastics as a uniform filling of the injection mould is facilitated by the internally and/or externally situated ribs and grooves, respectively.

In the manufacture of cartridges for live ammunition of the type having a case made of plastics problems can arise due to inadequate or excessive strength of the connection between the case and the projectile. These problems can be resolved according to an embodiment of the present invention illustrated in FIG. 5*a* representing a longitudinal sectional view of the top portion of a projectile-bearing ammunition cartridge positioned in the cartridge chamber of a weapon.

A bond control layer 55 is provided at the interface between projectile 51 and neck 53 of cartridge case 57, preferably on the projectile surface. For metal projectiles, layer 55 is made of a bond improving agent, i.e. a composition capable of increasing adhesion between a metal surface (projectile) and a plastics surface (cartridge case) such as, for example, polymers of the type used for interbonding the metal and plastics constituents of metal-coated plastics laminates. Such polymers include polar groups and can be selected, for example, from the class of copolymers made of olefins and of unsaturated organic acids, unsaturated acid esters or salts of unsaturated organic acids (ionomers).

When using projectiles made of plastics, on the other hand, the bond control layer will be of the type that decreases plastics/plastics adhesion or interwelding so that the plastics projectile will not be bonded too strongly to the plastics cartridge wall, e.g. when producing the plastics cartridge by injection molding with the projectile inserted into the mould.

According to a preferred modification, cartridge case 57 is provided with shoulder elements 56 formed an an integral part of the plastics cartridge case so that projectile 51 can be pushed into neck 53 of a preformed case 57 until the lower end of the projectile projects into the internal space 52 of case 57 and bears against the shoulder elements 56.

FIG. 5*b* further illustrates the arrangement of the shoulder elements in a cross-sectional view of the cartridge case of FIG. 5*a*.

According to another preferred embodiment of the projectile-bearing type ammunition cartridge having a projectile made of plastics the lower portion 512 of projectile 51 that penetrates into neck 53 and case 57 has a larger cross-sectional diameter than the upper portion 511 of projectile 51 that protrudes from the case, i.e. extends upward beyond edge 58 of neck 53. This embodiment assures that the ammunition cartridge can be inserted into the ammunition chamber of the weapon and easily removed therefrom even if not fired while, at the same time, providing for optimum projectile guidance in the barrel of the weapon upon firing.

It is to be noted that the terms "plastics casing", "plastics projectile" and "made of plastics" are not intended as a restriction to such objects as consist entirely of a plastics material. In fact, the cartridge case or case wall of any embodiment of the cartridge according to this invention may include a reinforcing inlay or layer of fibres such as glass fibres or of sheets or foils including reinforcing metal layers of the type known for reinforcing plastics objects. Cartridge cases consisting essentially of plastics compositions that may, or may not include particulate or fibrous fillers are generally preferred, however, for reasons of economy. Cartridge cases consisting of thermoplastic polymer compositions can be shaped by blowmoulding techniques, or may possess a molecular orientation that provides for a more or less pronounced reinforcing effect.

While the embodiments explained in connection with FIGS. 4*a*, 4*b* and 5*a*, 5*b* are preferably used with composite inserts of the type explained in connection with FIGS. 1–3, prior art all-metal inserts could be used if desired.

The essential advantages of the novel composite cartridge bottom insert according to the invention can be realized in combination with any ammunition cartridge that has a plastics case, notably for use in blank or live rifle ammunition. In addition to reduced costs of materials and production, the novel insert provides for functional improvements believed to be due to the fact that the metal/plastics connection is situated within the bottom insert rather than between the bottom insert and the cartridge case. Furthermore, the novel composite bottom insert requires comparatively less metal per cartridge and can be manufactured at less costs per unit.

Preferably, the novel bottom insert according to the invention is formed first by shapingly deforming, e.g. deep-drawing, of a metal sheet material, e.g. aluminum, aluminum alloy, steel, brass or the like, having a gauge substantially equal to that of the lower base portion of the metal bottom element, e.g. typically in the order of 1 mm ($\pm$ 0.3 mm) for rifle ammunition cartridges and, secondly, by anchoringly securing the metal element in the plastics sleeve element which may be preformed or, preferably, is formed of a suitable thermoplastics composition around the upper or anchoring portion of the metal element. Subsequently, a conventional detonator cap can be pressed into the cap-receiving and cap-holding chamber provided in the metal bottom element. Then, the completed assembly of cartridge bottom insert plus detonator cap is introduced into the lower end of the plastics cartridge case that may have a conventional structure or be designed in accordance with one of the preferred cartridge case embodiments disclosed herein. In general, a suitable charge will be provided within the case prior to closing its lower end with the cartridge bottom. Alternatively, the charge can be introduced via the top end of the cartridge case.

According to a preferred specific embodiment of the inventive manufacturing method, the metal sheet for producing the metal bottom element is provided in the form of a disc that may, or may not, have a central aperture, and deforming such disc in a punch-dye or the like for shapingly deforming the metal disc and producing a generally tubular cylindrical protrusion which, in a subsequent shaping step is pressingly deformed so as to form a flanged or rimmed upper portion 23 as depicted in FIG. 2. Aperture 28 may be formed in connection with this second step unless the disc-shaped blank used had such an aperture to start with, or produced subsequently.

Thus, it is apparent that the invention satisfies the objects, aims and advantages set forth above and provides for substantial improvements in connection with ammunition cartridges, notably for use in rifles. While the invention has been described in conjunction with specific embodiments, it is evident that many alternatives, modifications and variations will be apparent to those skilled in the art in the light of the foregoing description. Accordingly, it is intended to embrace all such alternatives, modifications and variations that fall within the spirit and broad scope of the appended claims.

Accordingly, What is claimed is:

1. An ammunition cartridge of the type comprising a cartridge case consisting, at least in a predominant cartridge case portion, of a synthetic plastics material and having a lower end portion for receiving and holding a cartridge bottom insert, said cartridge bottom insert being a composite unit comprising a single metal bottom element and a sleeve element made of a synthetic plastics composition, said single metal bottom element being firmly secured in said sleeve element, said sleeve element being molded onto said single metal bottom element and said single metal bottom element is an integral structure made of a sheet metal capable of being shaped by deep-drawing, said structure comprising a bottom plate having a diameter sufficient to form an extraction rim and having a coaxial chamber for receiving and holding a detonator cap, said chamber having an apertured upper wall portion and at least one laterally projecting means for anchoring said metal bottom element in said sleeve element.

2. An ammunition cartridge of the type comprising a cartridge case consisting, at least in a predominant cartridge case portion, of a synthetic plastics material and having a lower end portion for receiving and holding a cartridge bottom insert, said cartridge bottom insert being a composite unit comprising a single metal bottom element and a sleeve element made of a synthetic plastics composition, said single metal bottom element being firmly secured in said sleeve element, said sleeve element being molded onto said single metal bottom element and said single metal bottom element is an integral structure made of a sheet metal capable of being shaped by deep-drawing and comprising a chamber for receiving and holding a detonator cap and a pair of coaxial flange means, one of said flange means of said pair having a diameter that is smaller than the diameter of the other flange means of said pair, said metal bottom element further comprising a tubular portion interconnecting said pair of coaxial flange means, said flange means with said smaller diameter being shaped to anchor said metal bottom element in said sleeve element and said other flange means of said pair forming an extraction rim for the cartridge.

3. The ammunition cartridge of claim 1 suitable for use in rifles, wherein said sleeve element made of a plastics material is a generally rotationally symmetrical hollow structure having a cylindrical base and a body portion, said cylindrical base bearing against said other flange means of said pair of coaxial flange means and having a smaller external diameter than said other flange means so that an outer rim portion of said other flange means is provided for engagement with a cartridge ejector.

4. The ammunition cartridge of claim 3, wherein said body portion of said sleeve comprises at least one annular beading for engagement with an inner portion of said cartridge case.

5. The ammunition cartridge of claim 4, wherein said sleeve element comprises a projecting edge portion having an external diameter substantially equal to that of said cartridge case.

6. The ammunition of claim 5, wherein said sleeve element includes a conical aperture for connection of said chamber in said metal bottom element with a charge-receiving portion of said cartridge case.

7. The ammunition cartridge of claim 6, wherein said conical aperture has an axial depth at least equal to the axial depth of said metal bottom element.

8. The ammunition cartridge of claim 1, wherein said sleeve element consists of a synthetic organic thermoplastics composition having a ball-pressure hardness (60 inch) of at least about 500 $kp/cm^2$ and a modulus of elasticity of at least about $5 \times 10^{-3}$ $kp/cm^2$.

* * * * *